US005135284A

United States Patent [19]

Crum

[11] Patent Number: 5,135,284

[45] Date of Patent: Aug. 4, 1992

[54] KNOCK-DOWN CHAIR BACK BRACKET

[75] Inventor: Michael A. Crum, Bagdad, Ky.

[73] Assignee: Leggett & Platt, Incorporated, Carthage, Mo.

[21] Appl. No.: 641,718

[22] Filed: Jan. 9, 1991

[51] Int. Cl.[5] ..... A47C 07/00

[52] U.S. Cl. ..... 297/443; 403/330

[58] Field of Search ..... 297/443, 450, 444; 292/101, 304; 403/321, 330

[56] References Cited

U.S. PATENT DOCUMENTS

| | | | |
|---|---|---|---|
| 3,455,602 | 7/1969 | Cruz et al. | 297/444 X |
| 3,525,549 | 8/1970 | Knabusch et al. . | |
| 3,801,122 | 4/1974 | Shoemaker et al. . | |
| 3,848,924 | 11/1974 | Shoemaker et al. . | |
| 3,871,704 | 3/1975 | Shoemaker et al. . | |
| 3,973,798 | 8/1976 | White . | |
| 4,061,371 | 12/1977 | Prather et al. | 292/304 X |
| 4,082,355 | 4/1978 | Knabusch et al. . | |
| 4,154,475 | 5/1979 | Shoemaker et al. . | |
| 4,179,157 | 12/1979 | Shoemaker et al. . | |
| 4,367,895 | 1/1983 | Pacitti et al. . | |
| 4,477,118 | 10/1984 | Rubie . | |
| 4,613,186 | 9/1986 | LaPointe . | |
| 4,627,663 | 12/1986 | LaPointe . | |
| 4,804,227 | 2/1989 | Hansen . | |
| 4,826,348 | 5/1989 | Brightman | 403/330 |
| 4,932,720 | 6/1990 | Sherman . | |
| 5,005,908 | 4/1991 | Young | 297/443 |

*Primary Examiner*—Kenneth J. Dorner
*Assistant Examiner*—J. Bonifanti
*Attorney, Agent, or Firm*—Wood, Herron & Evans

[57] ABSTRACT

A knock-down chair back bracket assembly allows for removably securing a chair or sofa back to a chair or sofa base. The bracket assembly comprises a pair of matingly tapered interfitting brackets, one of which attaches to a base of a piece of seating furniture and the other of which attaches to a side of a back of a piece of seating furniture. The base mounting bracket has a pin at an upper end which is cooperable with a double cam lock lever pivoted to an upper end of the back slide bracket. The double cam lock lever has two cam surfaces one of which cams the mounting and slide brackets into fixed engagement and the other of which cams the brackets out of fixed engagement.

13 Claims, 2 Drawing Sheets

KNOCK-DOWN CHAIR BACK BRACKET

BACKGROUND OF THE INVENTION

1. Field of the Invention

This invention relates generally to furniture, and more particularly to chairs or sofas having a base, a seat mounted atop the base, and a back mounted to the base, and wherein the back is removable from the base.

2. Description of the Prior Art

Many of the chairs or sofas manufactured today have a seat mounted atop a base and a back mounted to the base. This typical chair configuration results in an efficient geometry for compact packing for shipment in commerce. Specifically, that volume forward of the back and above the seat is in effect wasted, for shipping purposes. It would therefore be desirable to effect a compact shipping configuration for such chairs or sofas in order to maximize the number of products shipped per unit volume, thereby minimizing shipping costs.

One such solution to this problem is disclosed in U.S. Pat. No. 3,525,549 issued to Knabusch et al. In the Knabusch '549 patent, a chair back is equipped with a slide bracket on each side edge. The slide bracket is composed of a web having inwardly presenting channel sections at the sides and top. Apertures in the web receive securing elements by which the brackets are secured to the back. A locking arm is pivoted to each slide bracket which draws the slide brackets into secured fixed relation with upwardly extending links on the chair which receive the slide brackets when moved downwardly thereover. The locking arms secure the brackets and links against separation and retain them in firm fixed relation against any movement when in use. By releasing the locking arms the back may be removed and placed upon the seat to substantially reduce the space occupied by the chair in storage and during shipping.

Another such scheme is disclosed in U.S. Pat. No. 4,082,355 to Knabusch et al. In the Knabusch '355 patent, a lockable back on a sofa bed is disclosed which uses slide brackets on the sofa back which mate with mounting brackets on the sofa arms. The slide brackets on the back are located at each end facing the rear portion of the inner surface of the sofa arm. This inner surface of the sofa arm has attached thereto a mounting bracket. The slide bracket includes a locking lever pivoted thereto containing a cam face which is moved toward a notch in the mounting bracket for locking the back to each of the arms. This scheme likewise provides a means by which the unit can be compactly assembled for shipment or storage, or for ease of moving the sofa through doors and the like.

A major disadvantage of the aforesaid mechanisms is that when the slide bracket is cammed into fixed engagement with the mounting bracket, the slide bracket is often difficult to separate from the mounting bracket when it becomes desirable to do so. This is because the camming action provides a greater amount of downward thrust on the slide bracket than that which can be generated by simply pulling upwardly on the slide bracket.

It would be desirable, then, to devise a mechanism wherein not only would the slide bracket be cammed into engagement with the fixed mounting bracket, but when one wished to disengage the slide bracket from the mounting bracket, the camming action could be reversed such that the slide bracket would be cammed out of engagement with the mounting bracket.

It has been one object of the present invention to provide a mounting mechanism wherein a chair or sofa back could be separated from a chair or sofa base in order to effect a compact configuration of the chair or sofa for shipping.

Another object of the present invention has been to provide means by which a chair or sofa back could be securely fixed to a chair or sofa base.

Yet another object of the present invention has been to provide means by which one may easily disengage a chair or sofa back from a chair or sofa base after the back has been brought into fixed engagement therewith.

SUMMARY OF THE INVENTION

The present invention is a knock-down item of seating furniture comprising a base, a seat mounted atop the base, a back, and a pair of interfitting brackets on each side of the item of seating furniture for removably connecting the back to the base. Each of the pair of brackets includes cam locking means for camming the pair of brackets into locked engagement and camming the pair of brackets out of locked engagement.

In a preferred embodiment, each pair of brackets comprises a tapered support bracket and a matingly tapered slide bracket. The cam locking means comprises a rotatable cam pivotally mounted upon one of the brackets of the pair of brackets and being engagable with the other of the brackets of the pair of brackets. When rotated in one direction, the cam is operable to cause the pair of brackets to be cammed into locked engagement, and when rotated in the other direction is operable to cause the pair of brackets to be cammed out of locked engagement.

Preferably the cam is mounted to the slide bracket and is in the form of a U-shaped double cam, wherein one leg of the "U" serves as one cam surface and the other leg of the "U" serves as the other cam surface. These two cam surfaces are cooperable with a pin or stop on the tapered support bracket. As the slide bracket is engagably lowered upon the support bracket, a lever on the cam is forced downwardly which causes the lower "U" cam surface to engage the lower side of the stop or pin on the support bracket. As the cam lever is forced downwardly this causes the lower "U" cam surface to pull and force the slide bracket downwardly upon the support bracket, into fixed securement therewith. As the cam lever is raised, the upper "U" cam surface engages the upper side of the pin or stop on the support bracket; continued movement of the cam lever upwardly pushes and cams the slide bracket upwardly and apart from the support bracket.

One advantage of the present invention is that camming action may be utilized to bring a chair or sofa back into fixed securement with a chair or sofa base, but without the disadvantage of being difficult to separate when desired.

Another advantage of the present invention is that a chair or sofa back may be easily secured to a base, and similarly easily removed from the base.

Yet another advantage of the present invention is that a chair or sofa having a seat, base and back may be compacted for more efficient shipping thereof.

These and other objects and advantages of the present invention will more readily become apparent from the following description of the drawings, in which:

DESCRIPTION OF THE PREFERRED EMBODIMENTS

Figure 1:
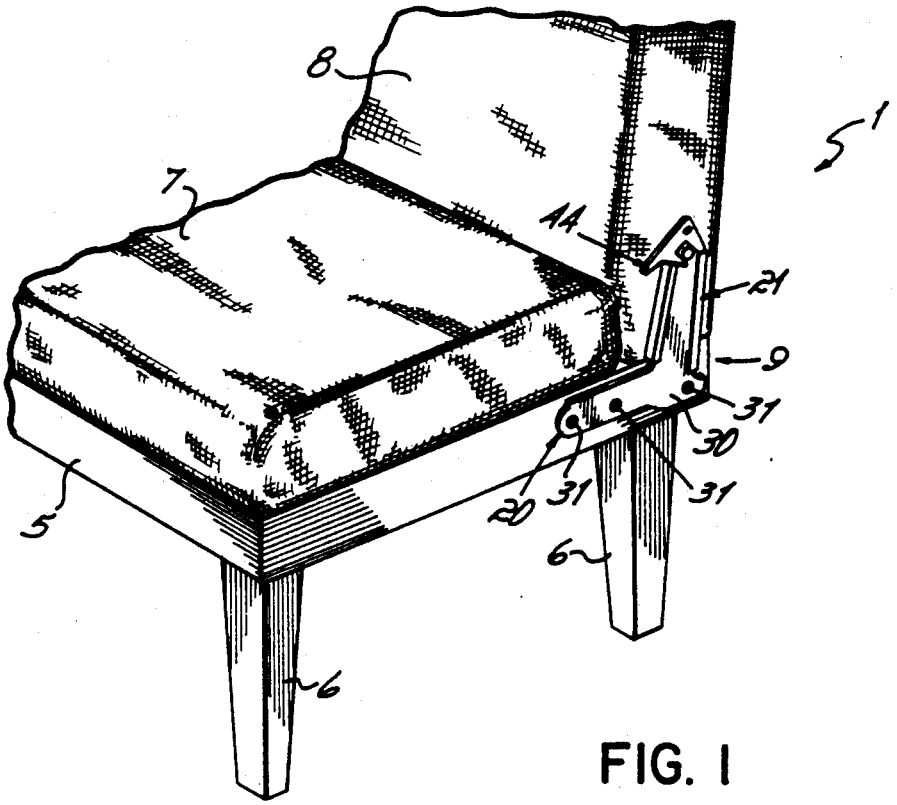
FIG. 1 is a perspective view of a portion of a chair embodying the present invention.

With reference to FIG. 1, there is illustrated a chair 1 embodying the present invention. While the preferred embodiment of the invention is illustrated and described in relation to a chair, it should be appreciated that it is equally applicable to a sofa or any other item of seating furniture which includes a seat and back rest. The chair 1 comprises a base 5, legs 6, a seat 7, a back 8, and a knock-down bracket assembly 9 on both sides of the chair 1 (only one of which is shown).

Figure 2:
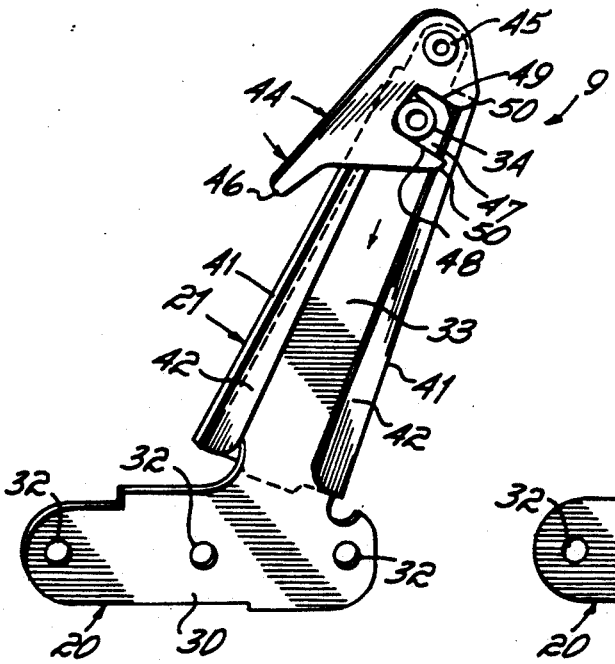
FIG. 2 is an enlarged view of a knock-down bracket assembly illustrating the camming action as the slide bracket is cammed into engagement with the mounting bracket.
Figure 3:
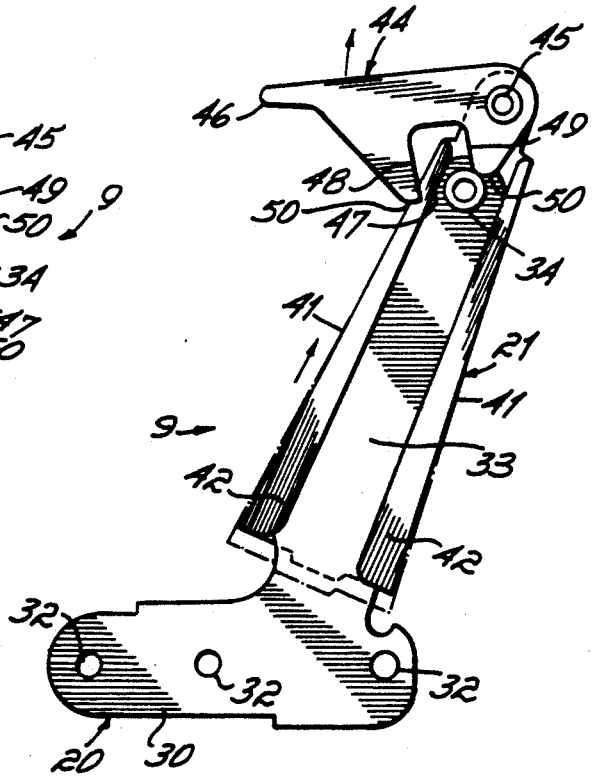
FIG. 3 is a view similar to FIG. 2 but illustrating the camming action of the slide bracket being cammed out of engagement with the mounting bracket.
Figure 4:
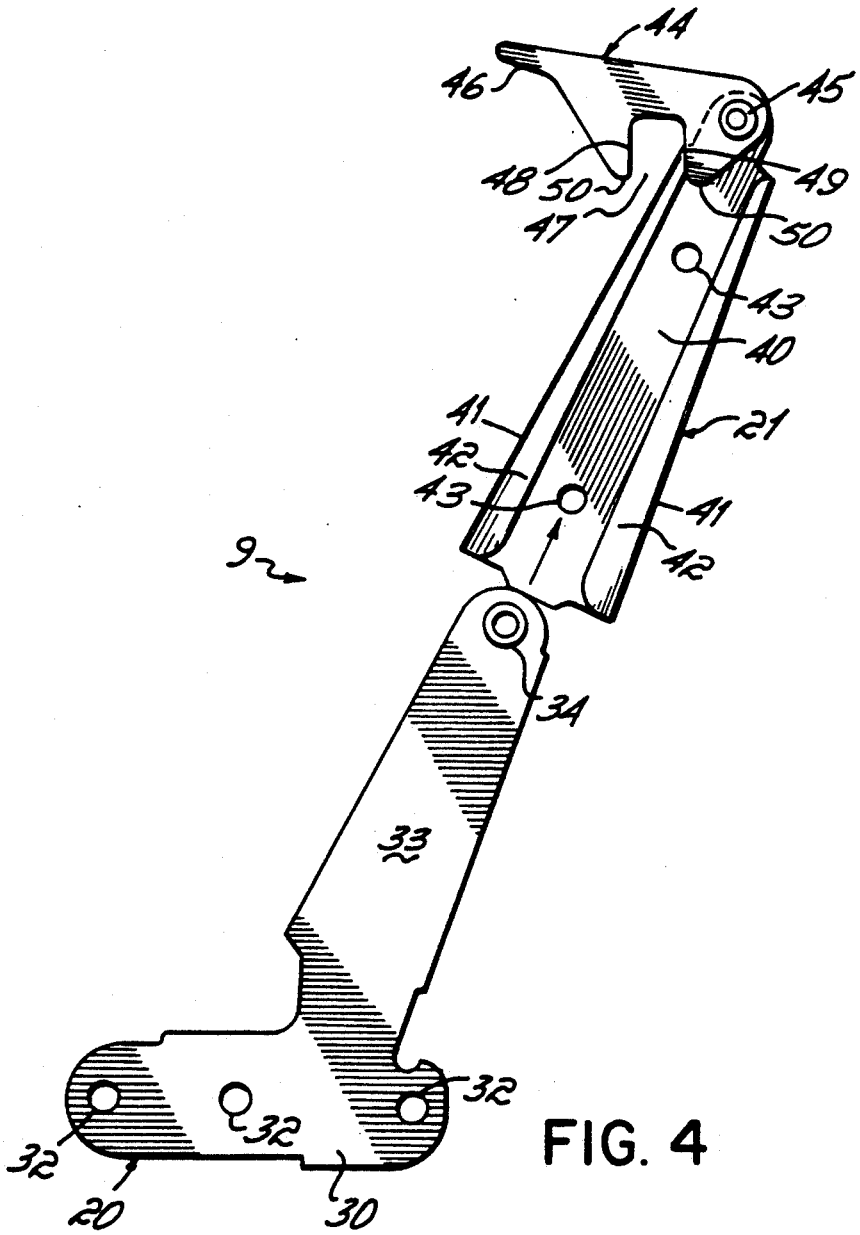
FIG. 4 is a view similar to FIGS. 2 and 3 illustrating the removal of a slide bracket from a mounting bracket.

Referring now to FIGS. 2–4, the knock-down bracket assembly 9 is illustrated and comprises a tapered mounting bracket 20 and a matingly tapered slide bracket 21.

The mounting bracket 20 has a lower portion 30 for attaching the mounting bracket 20 to the base 5 with, for example, screws 31 (shown in FIG. 1) inserted through holes 32. The mounting bracket 20 further includes an upstanding link portion 33, which is tapered toward its upper end. The upstanding link portion 33 of the mounting bracket 20 further includes a press nut, pin or stop 34 or the like at its upper end.

The slide bracket 21 is matingly tapered toward its upper end for complementarily fitting onto the mounting bracket 20. The slide bracket 21 is essentially a shallow channel section comprising a web 40, flanges 41 and an inwardly turned lip 42 attached to each flange 41. The slide bracket 21 further includes a plurality of holes 43 for attaching the slide bracket 21 to the sides of a chair back 8 by, for example, screws or the like (not shown). At the upper end of the slide bracket 21 there is a double cam lock lever 44. This double cam lock lever 44 is hingably connected to the upper end of the slide bracket 21 by pin 45. The double cam lock lever 44 includes an actuating lever 46, and a U-shaped cam indentation 47. This U-shaped cam indentation 47 is comprised of a first cam surface 48 and a second cam surface 49, which are essentially the legs of the "U" shaped cam 47. The ends of the "U" shaped cam are slightly rounded at 50 for ease of engagement with a pair of differing surfaces of the pin or stop 34, more fully described hereafter.

Describing the operation of the present invention, and referring now to FIG. 2, it will be seen that as the slide bracket 21 is slid downwardly over the mounting bracket 20, the lever 46 of the double cam lock lever 44 may be rotated downwardly, thus causing the cam surface 48 to engage the lower edge or side of the pin or press nut 34 the lower edge or side of pin 34 being one of the pair of differing surfaces of the pin 34. As the lever 46 is forced further downwardly, the cam surface 48 interacting with the press nut 34 causes the slide bracket 21 to be forced downwardly upon the mounting bracket 20 through a displacement of approximately one fourth of an inch so as to thereby wedge the upstanding link portion 33 of the bracket 20 within the channel portion of the slide bracket 21. The chair back 8 is then securely attached to the chair base 5 so that an occupant may now sit therein.

Referring now to FIG. 3, to disengage a chair back from a chair base, the lock lever 46 is raised upwardly which causes the cam surface 49 to engage the upper side of the pin or press nut 34 the upper edge or side of pin 34 being the other of the pair of differing surfaces of the pin 34. Continued upward movement of the lever 46 and hence the double cam lock lever 44 causes the slide bracket 21 and hence chair back 8 to rise upwardly and away from the mounting bracket 20 and hence the chair base 5. This camming action thereby frees the slide bracket (FIG. 4) from its wedged state of securement upon the mounting bracket 20, such that one may then completely remove the back 8 and place it atop the chair seat 7 to effect a compact configuration of the chair for shipping purposes.

While I have described only one embodiment of my invention, those skilled in the art will readily recognize adaptations and modifications which can be made to the present invention which will result in an improved knock-down chair, yet without departing from the spirit or scope of the appended claims. Accordingly, I intend to be limited only by the claims.

What is claimed is:

1. A knock-down item of seating furniture comprising
a base,
a seat mounted atop said base,
a back, and
a pair of interfitting brackets on each side of said item of furniture for removably connecting said back to said base, each of said pair of brackets including cam locking means for camming said pair of brackets into locked engagement and camming said brackets out of locked engagement.

2. The item of claim 1 wherein each of said pair of brackets comprises a tapered support bracket and a matingly tapered slide bracket.

3. The item of claim 2 wherein said cam locking means comprises a rotatable cam pivotally mounted upon one of said brackets of said pair of brackets and engagable with the other of said brackets of said pair of brackets, said cam being rotatable in one direction to cause said pair of brackets to be cammed into locked engagement and rotatable in an opposite direction to cause said pair of brackets to be cammed out of locked engagement.

4. The item of claim 3 wherein said rotatable cam has a pair of cam surfaces thereon, one of said pair of cam surfaces being engagable with said other of said brackets when said cam is rotated in one direction and the other of said pair of cam surfaces being engagable with said other of said brackets when said cam is rotated in said opposite direction.

5. The item of claim 4 wherein said pair of cam surfaces are engagable with a pair of differing surfaces of said other of said brackets.

6. The item of claim 2 wherein said cam locking means comprises a cam lock lever having first and second cam surfaces engagable with a stop and operable between each said support bracket and mated slide bracket such that when said first cam surface engages said stop said support and mated slide bracket are cammed into locked engagement and when said second cam surface engages said stop said support and mated slide bracket are cammed out of locked engagement.

7. A pair of interfitting brackets for removably connecting a back to a base of an item of seating furniture comprising a tapered mounting bracket adapted to be attached to said base, said mounting bracket having an upstanding link tapered towards an upper end thereof, said upper end having fixedly attached thereto a cylindrical pin; and a matingly tapered slide bracket adapted to be attached to said back, said slide bracket having a web tapered toward an upper end thereof, said web having flanges on either side thereof, said flanges having inwardly turned lips, said web, flanges and lips forming a receiving structure for receiving said upstanding link, and cam means pivotally connected to said upper end of said slide bracket for cooperation with said mounting bracket pin for camming said pair of brackets into locked engagement and camming said brackets out of locked engagement.

8. The bracket pair of claim 7 wherein said cam means comprises a double cam lock lever having a U-shaped cam indentation defining a first cam surface and a second cam surface, said first cam surface being engagable with a lower edge of said mounting bracket pin for camming said slide bracket into fixed securement with said mounting bracket, said second cam surface being engagable with an upper edge of said mounting bracket pin for camming said slide bracket out of fixed securement with said mounting bracket.

9. A pair of interfitting brackets for removably connecting a back to a base of an item of seating furniture comprising a tapered mounting bracket adapted to be attached to one of said base and said back, said mounting bracket having an upstanding link tapered towards an upper end thereof, said upper end having fixedly attached thereto a cylindrical pin; and a matingly tapered slide bracket adapted to be attached to the other of said base and said back, said slide bracket having a web tapered towards an upper end thereof, said web having flanges on either side thereof, said flanges having inwardly turned lips, said web, flanges and lips forming a receiving structure for receiving said upstanding link, and cam means for camming said pair of brackets into locked engagement and for camming said brackets out of locked engagement.

10. The bracket pair of claim 9 wherein said cam means is pivotally connected to said upper end of said slide bracket and is engagable with said cylindrical pin of said mounting bracket.

11. The bracket pair of claim 10 wherein said cam means comprises a double cam lock lever having a U-shaped cam indentation defining a first cam surface and a second cam surface, said first cam surface being engagable with a lower edge of said mounting bracket pin for camming said slide bracket into fixed securement with said mounting bracket, said second cam surface being engagable with an upper edge of said mounting bracket pin for camming said slide bracket out of fixed securement with said mounting bracket.

12. A pair of interfitting brackets for removably connecting a back to a base of an item of seating furniture comprising a tapered mounting bracket adapted to be attached to one of said base and said back, said mounting bracket having an upstanding link tapered towards an upper end thereof, said upper end having fixedly attached thereto a cylindrical pin; and a matingly tapered slide bracket adapted to be attached to the other of said base and said back, said slide bracket having a web tapered towards an upper end thereof, said web having flanges on either side thereof, said flanges having inwardly turned lips, said web, flanges and lips forming a receiving structure for receiving said upstanding link, and cam means pivotally connected to one of said brackets for camming said pair of brackets into locked engagement upon rotation in one direction and for camming said pair of brackets out of locked engagement upon rotation in an opposite direction.

13. The bracket pair of claim 12 wherein said cam means comprises a double cam lock lever having a U-shaped cam indentation defining a first cam surface and a second cam surface, said first cam surface being engagable with the other of said brackets for camming said one of said brackets into fixed securement with said other of said brackets, said second cam surface being engagable with said other of said brackets for camming said one of said brackets out of fixed securement with said other of said brackets.

* * * * *